United States Patent [19]

Randoll

[11] 4,240,396

[45] Dec. 23, 1980

[54] GAME-BALLOON LAUNCHER

[76] Inventor: William M. Randoll, 653 Loring St., San Diego, Calif. 92109

[21] Appl. No.: 941,130

[22] Filed: Sep. 11, 1978

[51] Int. Cl.[3] ..... F41B 3/02

[52] U.S. Cl. ..... 124/17; 273/424; 273/428; 273/400

[58] Field of Search ..... 124/17, 16, 35, 41 R, 124/20 R, 21; 273/106 R, 98, 101, 106.5 R, 97 R

[56] References Cited

U.S. PATENT DOCUMENTS

| | | | |
|---|---|---|---|
| 47,815 | 5/1865 | Hall | 124/21 |
| 300,415 | 6/1884 | Van Allen | 124/17 |
| 1,345,561 | 7/1920 | Smithwick | 124/20 R |
| 2,645,217 | 7/1953 | Fisher | 124/20 B |
| 3,277,878 | 10/1966 | Pankratz | 124/20 R |
| 3,306,278 | 2/1967 | Spatari | 124/22 |

*Primary Examiner*—Richard C. Pinkham
*Assistant Examiner*—William R. Browne
*Attorney, Agent, or Firm*—Paul H. Gallagher

[57] ABSTRACT

The device includes a main part, or launcher, in the form of a slingshot, of large size, for operation by three people. The launcher includes a funnel acting as a holder for the balloon to be launched, secured to a pair of elastic strings respectively secured at their outer ends to handles. A balloon filled with water is placed in the holder, and one person holds each of the handles, while a third draws the holder back and releases it, this action flinging the balloon at a target. The device also includes a container for the launcher, and the container has a cover which also serves as a flying saucer.

3 Claims, 8 Drawing Figures

GAME-BALLOON LAUNCHER

OBJECTS OF THE INVENTION

A main object is to provide a new game of unusual interest directed particularly to young adults, as distinguished from small children.

A more specific object is to provide a game of the foregoing character which is in the nature of a launcher for water-filled balloons, the balloons acting as projectiles that can be projected or flung to a great distance. The targets may be either inanimate objects, or people, the balloons striking people without injury or any discomfort.

A still more specific object is to provide a game of the foregoing nature that is made of such materials that are extremely strong and little susceptible to breakage or erosion, and can be used many times and over long periods of time without material wear, despite substantial stresses applied to it by larger persons. Moreover the parts are attractive in appearance and inexpensive.

A further object is to provide a game of the foregoing character in conjunction with a container therefor, in which the container can be used as a target.

An additional object is to provide a game and container of the character just referred to wherein the container has a specially shaped cover which will act as a flying disc or flying saucer.

DESCRIPTON OF A PREFERRED EMBODIMENT

Figure 1:
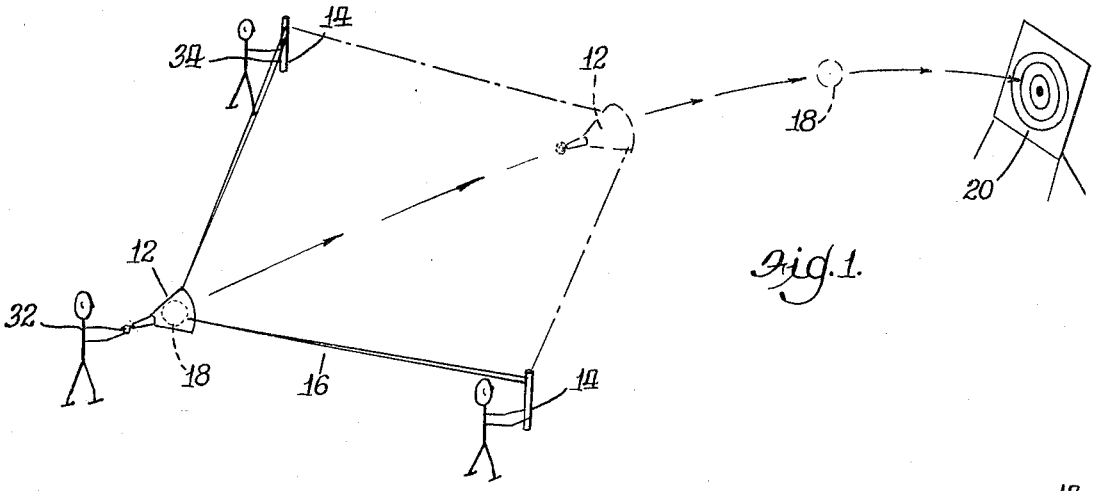
FIG. 1 is a schematic view of the game indicating its manner of use.

Referring in detail to the accompanying drawings, the launcher is indicated as a whole at 10 and includes a holder 12, a pair of handles 14, and elastic strings 16 securing the handles to the holder. A balloon or projectile 18 is thrown by the holder toward a target 20.

Figure 2:
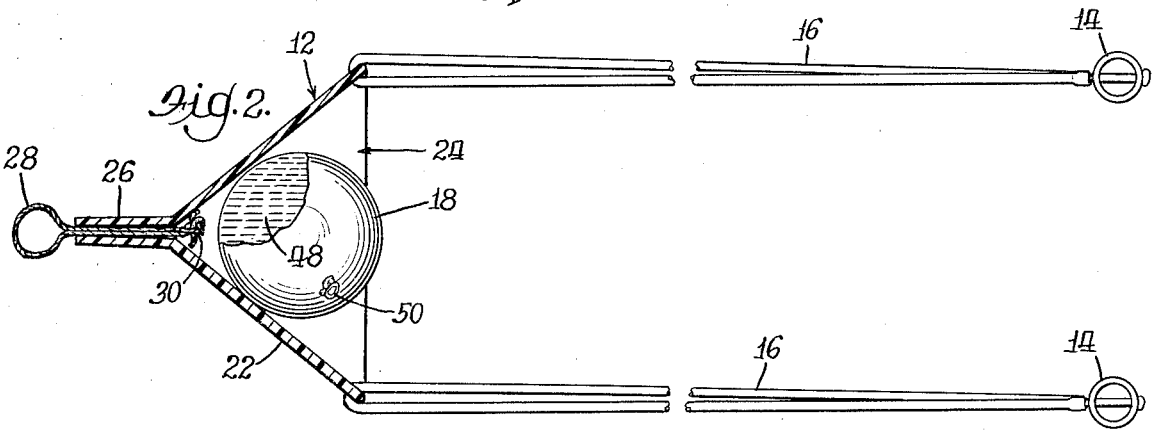
FIG. 2 is a large scale detail view of the launcher, per se, showing portions in section.
Figure 3:
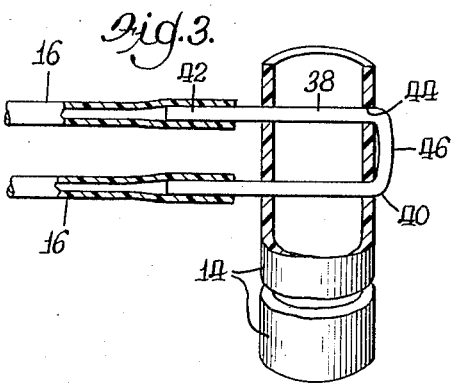
FIG. 3 is a detail view of one of the handles and the elastic string oriented according to line 3—3 of FIG. 2 and shown partially broken away.

The details of construction of the launcher are shown best in FIGS. 2 and 3. The holder 12 is preferably in the form of an ordinary funnel having a conical or tapered portion 22 defining a reduced portion 26, preferably tapered but at a lesser taper than the portion 22.

A gripper element 28 is provided which preferably is in the form of a loop, made up of a flexible rope or string, with end elements extended through the conical portion 26 and tied into an enlarged knot 30. The knot prevents the gripper element from being pulled out when the person launching grips it and pulls the launcher back.

The handles 14 are simple tubes and may be of any suitable size, such as 1" diameter, and of suitable length such as one foot. These handles are thus easily held and can be gripped with both hands. In FIG. 1 the person launching the balloon is indicated at 32, and the persons holding the handles at 34.

The flexible strings 16 are double-stranded, flexible and elastic tubular hose-like elements, circular in cross-section, fitted to the holder 10 by extending a strand through apertures 36 in the holder. Each handle is provided with a connector or adapter 38 (see also FIG. 3) which also is tubular but of limited flexibility. These adapters can be bent at right angles as indicated at 40 whereby the extended ends 42 are fitted through apertures 44 in the handles. Each adapter is thus bent in the shape of a "U", the base 46 of which extends along the length of the handle between the apertures. The tubing of the adapters 38 is normally circular in cross-section, the wall of the element being of substantial thickness. This circular cross sectional shape works to effectively cooperate with the strings 16 which, as noted above, are also tubular and normally circular in cross-section. The extended ends of the strings 16 are telescoped over the extended ends 42 of the adapter, and the strings being highly elastic, and upon being so telescoped, tighten on the extended end 42 of the adapter and produce a great gripping effect. In fact the greater the strings 16 are extended, the greater is this gripping effect.

The parts making up the launcher as referred to above may be of any desired material to accomplish the results mentioned. Various plastic materials are convenient and effective for use. The great elasticity of the strings 16 in addition to being able to hurl the projectile a great distance also works toward producing a tight gripping effect on the connectors 38. The handles 14 as well as the connectors, may be for example be transparent, for appearance sake. The various plastic materials are extremely strong and produce outstanding results in the fabrication and functioning of the device. While plastic materials may be preferred, other materials are not excluded, such as rubber or other rubber-like material providing the necessary elasticity of the strings 16.

The balloon or projectile 18 may be a simple rubber balloon of known kind filled with water as indicated at 48 and tied as indicated at 50.

The balloon 18 is preferably very thin, and it may be of the character of toy balloons, so that it readily breaks upon impact with the target, but it remains intact otherwise. In the use of the device, the balloon 18, filled as stated, is placed in the holder 12; two persons hold the handles 14 as indicated in FIG. 1, at a substantial distance apart. The person launching, grips the loop 28 and draws the holder back, against the elasticity of the strings 16 and the holding effect of the persons holding the handles 34. He then releases the holder and it is thrown or flung forward as shown in dot-dash lines in FIG. 1. The balloon 18 is thrown or projected toward the target which in general use, may be any kind of target.

In a device of this kind, with the elastic strings 16 approximately 2½ feet in doubled length (5 feet linear) three persons of adult size launch a balloon filled with water. In that case the open end of the holder was approximately 8 inches in length from left to right of FIG. 2. The strands making up the elastic strings 16 were in the neighborhood of ½ inch outer diameter, and the balloon was in the neighborhood of 5–6 inches in diameter. The balloon was projected a distance of over 100 yards.

In such use of the balloon launcher, there is no danger of the balloon being broken or collapsed or in any way impaired while it is in the holder, in the act of being launched. The inertia of the balloon, in the forward movement of the holder, of course forces a portion of the balloon farther back into the holder or funnel, but nevertheless this does not produce any impairment, or objectionable wedging effect.

The balloon wall is of such selected thickness that it will easily break upon impact of the balloon with the target. This effect heightens the enthusiasm of using the device in that a splash of water is more attention-getting than merely hitting a target without the balloon so breaking.

Figure 5:
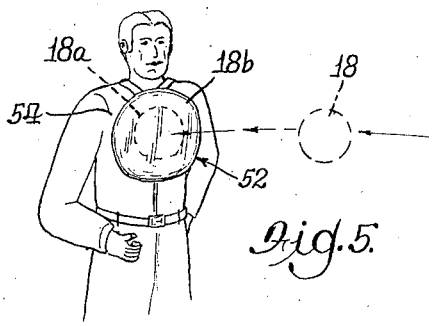
FIG. 5 is a diagrammatic view of a person and the action of the balloon in approaching and striking the person.

A part of the enthusiasm of the game is striking a person with the balloon. It is emphasized that this is not a dangerous action, particularly in the case of larger youths. The balloon is of course highly flexible and upon impact with a target or an object, it is highly distorted so that the force of the impact is spread out over quite an area, as contrasted with concentrating all the force in a small area. FIG. 5 represents this effect. In that figure the balloon 18 is shown in normal condition in full lines, namely, nearly spherical in shape, in its trajectory. When it strikes the target person, indicated at 52, it spreads from its normal small size, spherical shape 18*a*, to a larger circumference size as indicated at 18*b*. In the action of the balloon striking a person, the first contact would be a theoretical point contact between the balloon and the target, but of course the actual contact area covers an area much greater than a point. As the balloon proceeds further, it spreads so that the force of the impact is spread over an immensely greater area as represented by the solid line 18*b*. The impact force per unit area is very small in the great area covered by the spread balloon. In this action the balloon will break, but nevertheless the force per unit area is reduced as referred to.

Figure 6:
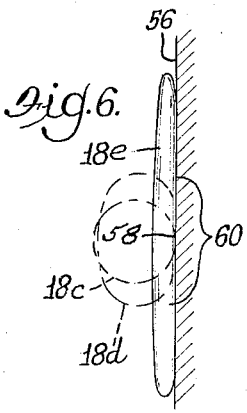
FIG. 6 is a detail view of a balloon in position just after impact with a target.
Figure 8:
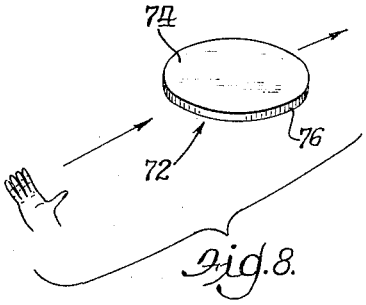
FIG. 8 is a detail view of the cover of the container of FIG. 7 and an indication of its flying action.

FIG. 6 represents this action in more detail. In this figure a target is represented at 56 which may be of any kind whether a flat, inanimate target such as 20 in FIG. 1, or a person's body as in FIG. 5; the target 56 in FIG. 6 is purposely illustrated relatively flat to simplify the description of the phenomenon. In FIG. 6 the balloon 18 is represented in its normal near-spherical shape at 18*c*, and engages the target at 58 which theoretically is a point, but as stated above, actually it covers an area. As the balloon continues its movement toward the target, it gradually assumes intermediate shapes, one of which is indicated at 18*d* in which as seen the balloon is somewhat flattened, and extends over a greater area. The relatively flattened balloon at position 18*d* covers an area represented by the bracket 60, which is a substantially greater area than that indicated at 58. This area 58, 60, etc. progressively increases as the balloon flattens more, and its final condition is indicated at 18*e* where it is of much greater transverse dimension, generally circular, but very flat. This area covered by the flattened balloon is immense and the force of the impact is very slight per unit area. This gradual increase and spreading of the impact area produces an effect much less intense even than a balloon of the original shape of 18*e* hitting a target. Accordingly there is no danger in the use of the device with a larger person as a target.

Figure 4:
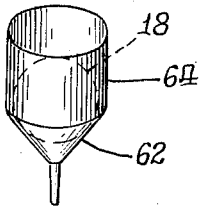
FIG. 4 is a small scale view of an alternate form of a balloon holder.

While the holder 12 may be in the shape of an ordinary funnel as mentioned above, it may instead assume the shape of FIG. 4 where at the rear it is shaped as an ordinary funnel as at 62 but at the front has an extension 64 generally cylindrical. This shape works toward greater accuracy in flinging the balloon at a target.

Figure 7:
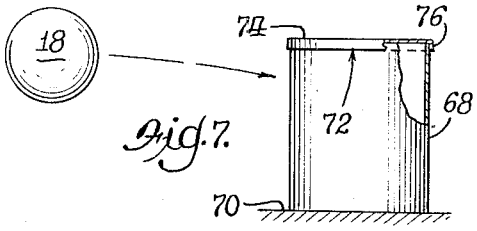
FIG. 7 is a view of a container for the lauancher.

FIG. 7 shows a container 68 for the launcher and balloons. The container itself may be used as a target, a position for such use being indicated by the container resting on a base 70. The use of the container as a target assures that a target is provided in the event there is no other incidental target accessible.

An additional feature of the invention is the incorporation of a cover or lid 72 which itself may be used as a game device. The cover has a top element 74 which may be flat, or nearly so, or otherwise shaped, and a surrounding down-turned rim or skirt 76. When the cover is fitted to the body of the container the rim 76 of course telescopes over the upper edge thereof. This cover is thus so shaped as to enable it to be thrown in the air and it glides in the manner of a flying disc, or "flying saucer," the cover thus providing an added attraction to the overall device. As an added feature, the flying saucer, may be utilized as a target while it is in the air, for the balloon launcher.

I claim:

1. A game comprising a launcher and a balloon, the launcher including:

(a) a holder having a recess for receiving the balloon;

(b) a pair of handles;

(c) a pair of elastic strings interconnecting the holder and respective handles;

the balloon being filled with water, and easily breakable, the launcher being separate and detached from all other mountings and instrumentalities and being of substantial size to render it practical for utilization by three persons, namely one holding each of the handles and one manipulating the holder, and the launcher being adapted for free movement of the persons so as to enable positioning of it without restriction, and the size thereof being so great as to require substantial exertion by each of the persons to manipulate the game, the holder being adapted to be drawn in a rearward direction against the elasticity of the strings and the supporting action of the handles, and released for projecting the balloon from the holder, the balloon being so flexible as to readily spread a great extent in directions transverse to the direction of impact with a target, and to be easily broken upon such impact.

2. A game according to claim 1 further characterized in that:

(a) the holder has a funnel-shaped member with a conical recess at a forward end for receiving the balloon, and a hand grip in the form of a rope separate from the funnel-shaped member and having a loop extending rearwardly through a hole in the funnel-shaped member and secured therein by a knot in the rope within the funnel-shaped member, (b) each handle is a rigid tubular piece of a length convenient for holding in two hands by one of the persons, and having longitudinally spaced transverse holes therethrough, and each includes a flexible connector bent into U-shape with legs extending through the holes, and (c) each elastic string is of tubular shape and threaded through apertures in the funnel-shaped member at the front-end edge of the latter and thereby having central loop portions engaging the funnel-shaped member and individual strands extended therefrom, and the extended ends of the strands being friction-fitted in telescoping relation over the legs of the corresponding connector.

3. A game according to claim 2 in conjunction with, a container for the launcher of a size to effectively hold only the launcher and including a container proper and a lid therefor separate therefrom, the lid including a main transverse top element with a depending encircling rim, and the lid being capable of gliding as a flying disc upon being thrown, and thereby serving as a game in itself and as a target for the launched balloon.

* * * * *